US008480132B2

(12) United States Patent
Kobayashi

(10) Patent No.: US 8,480,132 B2
(45) Date of Patent: Jul. 9, 2013

(54) BOOK COVER CORE BODY FOR MANUFACTURING BOOK COVER MEMBER, KIT FOR MANUFACTURING BOOK COVER MEMBER, AND ADHESIVE TAPE

(75) Inventor: Hiroshi Kobayashi, Tokyo (JP)

(73) Assignee: Kobayashi Co., Ltd., Tokyo (JP)

( * ) Notice: Subject to any disclaimer, the term of this patent is extended or adjusted under 35 U.S.C. 154(b) by 996 days.

(21) Appl. No.: 11/883,448

(22) PCT Filed: Jan. 31, 2006

(86) PCT No.: PCT/JP2006/301573

§ 371 (c)(1),
(2), (4) Date: Sep. 26, 2007

(87) PCT Pub. No.: WO2006/082813

PCT Pub. Date: Aug. 10, 2006

(65) Prior Publication Data

US 2008/0197617 A1 Aug. 21, 2008

(30) Foreign Application Priority Data

Feb. 1, 2005 (JP) ..... 2005-024712

(51) Int. Cl.

| | |
|---|---|
| ***B42D 3/00*** | (2006.01) |
| ***B42D 1/00*** | (2006.01) |
| ***B42D 3/04*** | (2006.01) |
| ***B42D 19/00*** | (2006.01) |
| ***B42D 5/00*** | (2006.01) |
| ***B42D 15/00*** | (2006.01) |

(52) U.S. Cl.
USPC ..... 281/29; 281/3.1; 281/4; 281/9; 281/15.1; 281/17; 281/19.1; 281/34; 281/36; 281/37; 283/63.1; 283/64

(58) Field of Classification Search
USPC ..... 281/3.1, 4, 9, 15.1, 17, 19.1, 29, 281/34, 35, 36, 37, 42, 45, 51; 283/63.1, 283/64, 117; 402/73, 74, 75, 76, 77, 78, 80 R, 402/502
See application file for complete search history.

(56) References Cited

U.S. PATENT DOCUMENTS

| | | | | |
|---|---|---|---|---|
| 3,964,770 | A * | 6/1976 | Abildgaard et al. | 281/29 |
| 4,863,191 | A * | 9/1989 | Termanis | 281/29 |
| 5,110,038 | A * | 5/1992 | Pantisano et al. | 206/551 |
| 2006/0061083 | A1 * | 3/2006 | Didde | 281/21.1 |

FOREIGN PATENT DOCUMENTS

JP 8-132758 A 5/1996

(Continued)

*Primary Examiner* — Dana Ross
*Assistant Examiner* — Justin V Lewis
(74) *Attorney, Agent, or Firm* — Birch, Stewart, Kolasch & Birch, LLP

(57) ABSTRACT

Provided is a book cover core body and a kit, which are used for manufacturing a book cover member which allows the original book to be finished easily, accurately, and neatly when an individual prepares an original book according to his taste without having to use an auxiliary tool such as a ruler and a stabbing. In the book cover core body used for manufacturing the book cover member and the kit including the same, at least a front cover core and a back cover core are glued at a predetermined interval (L) to a reverse side of a book cover print sheet with a book cover pattern, a title or the like drawn thereon, the book cover member being equipped with a front cover part, a spine part, and a back cover part, and the book cover core body including the front cover core, the back cover core, and a holding part having the same width as the above-mentioned interval (L), in which the front cover core and the back cover core are held integrally through an intermediation of the holding part, and in which, after the front cover core and the back cover core have been glued to the reverse side of the book cover print sheet, the holding part is separable from the front cover core and the back cover core.

12 Claims, 7 Drawing Sheets

FOREIGN PATENT DOCUMENTS

| | | | |
|---|---|---|---|
| JP | 2002-19329 | A | 1/2002 |
| JP | 2002-166679 | A | 6/2002 |
| JP | 2005-262839 | A | 9/2005 |
| JP | 2006-289649 | A | 10/2006 |

* cited by examiner

BOOK COVER CORE BODY FOR MANUFACTURING BOOK COVER MEMBER, KIT FOR MANUFACTURING BOOK COVER MEMBER, AND ADHESIVE TAPE

TECHNICAL FIELD

The present invention relates to a book cover core body for manufacturing a book cover member, a kit for manufacturing a book cover member, and an adhesive tape which make it possible to obtain easily and with a satisfactory finish a book cover member in which at least a front cover core and a back cover core are glued at a predetermined interval to the reverse side of a book cover sheet with a book cover pattern, a title, etc. drawn thereon. In particular, the present invention relates to a book cover core body, a kit for manufacturing a book cover member, and an adhesive tape which are suitable for obtaining a book cover member to be used as a book cover when manufacturing an original book according to the taste of an individual.

BACKGROUND ART

Manufacturing of bound printed matter, such as books and magazines, is usually conducted entirely by experts in printing companies or publishing companies from the editing to the bookbinding; in editing, there are conducted operations, such as the selection of the subject matter, the drafting and proofreading of the manuscript, the selection of photographs, illustrations, etc., the layout of the manuscript, photographs, illustrations, etc., and the preparation of a block copy and printing; and, as the bookbinding operations, there are conducted the binding of the printed text, etc. by threads, wires, adhesive or the like, and the completion of the format by using a printed cover, end leaves, a title page, etc.

In recent years, as a result of the marked progress in the functions of personal computers and printers, and with the advent of a digital video and a digital camera, it is possible to easily take taken images into a personal computer for editing; thus, the professional editing operations, which have mainly been performed in publishing companies or the like, can be easily conducted by an individual on the personal computer. Thus, there is a demand for enabling the individual to finally put such images together and bind them into a booklet as a record book or an original book to his taste. To put in order and store picture postcards, New Year's greeting post cards, greeting cards, printed photos, visiting cards, menus, various list slips, etc. possessed by an individual, it is general practice to use a dedicated binder, a file case or the like. However, such existing products are limited to a certain degree in size; further, due to the use of a ring type binding tool or the like, they are rather bulky for storage purposes. Further, in some cases, it is necessary to directly make predetermined holes in picture postcards or the like. Thus, also regarding mediums in the form of cards, there is a demand for enabling an individual to put them together and bind into a booklet according to the purpose.

To meet the above-mentioned demands, the present inventors have already proposed a bookbinding kit enabling an individual to perform bookbinding at home easily and at low cost without needing any aid of an expert (JP 2002-166679 A).

In performing bookbinding operation, it is necessary, for example, to maintain the book form and to firmly protect the text sheets to be bound, so the book cover is required to exhibit a certain degree of durability and toughness. Thus, to make such an original book as mentioned above, there is used a book cover member formed by gluing a front cover core and a back cover core to the reverse side of a book cover sheet with a book title, a book cover pattern according to the taste of the individual, etc. drawn thereon.

The book cover member constitutes, as it were, the face of the book, so accuracy and neatness in finishing is required thereof; for example, the book title should be at the correct position on the spine and the front cover, and the book cover pattern should be placed at the correct position. For this purpose, it is necessary to perform accurate positioning on the above-mentioned cores with respect to the book cover sheet; in particular, since the cores must be glued to the reverse side of the book cover sheet with the book cover pattern, etc. drawn thereon, it is rather difficult to perform positioning thereon with respect to the patterns or the like on the front surface; thus, in the operation of preparing the book cover member, it has been impossible to avoid the use of auxiliary tools, such as a ruler for accurate measurement of the positional relationship and a stabbing for clarifying the core gluing positions. Further, in view of the fact that the range of the age of the user desiring preparation of an original book is gradually expanding nowadays, there is a demand for an improved technique for further facilitating the preparation of a book cover member.

Apart from this, there is a demand for a technique which makes it possible to freely add new text sheets to an original book already completed by binding together a plurality of text sheets, or to remove some text sheets therefrom without damaging the text sheets already bound. In a conventional book finished through professional bookbinding, the text portions are firmly glued so as to be superimposed one upon the other so that no detachment of text sheets may occur; thus, it is rather difficult to freely remove text sheets or add other text sheets without damaging them. Patent Document: JP 2002-166679 A

DISCLOSURE OF THE INVENTION

Problems to be Solved by the Invention

After careful study on means making it possible to prepare a book cover member more easily without needing the use of auxiliary tools such as a ruler, the inventors of the present invention have found out that, by previously holding the front cover core and the back cover core to be glued to the book cover sheet integrally through the intermediation of a holding part, and by forming the front cover core and the back cover core such that they can be separated after being glued to the book cover sheet, it is possible to easily prepare the book cover member and to finish it accurately and neatly, thus completing the present invention.

It is accordingly an object of the present invention to provide a book cover core body for manufacturing a book cover member which helps to easily obtain a book cover member to be used when an individual prepares an original book according to his taste without having to particularly use an auxiliary tool such as a ruler and a stabbing, and which allows the original book to be finished accurately and neatly.

Means for Solving the Problem

That is, according to the present invention, there is provided a book cover core body for manufacturing a book cover member having a front cover part, a spine part and a back cover part which is made by gluing at least a front cover core and a back cover core at a predetermined interval L to a reverse side of a book cover sheet with a book cover pattern, a title or the like drawn thereon, in which the book cover core body is comprising the front cover core, the back cover core, and a holding part having the same width as the above-mentioned interval L, in which the front cover core and the back cover core are held integrally through an intermediation of the holding part, and in which, after the front cover core and the back cover core have been glued to the reverse side of the book cover sheet, the holding part is separable from the front cover core and the back cover core.

According to the present invention, there is provided a kit for manufacturing a book cover member having a front cover part, a spine part and a back cover part which is made by gluing at least a front cover core and a back cover core at a predetermined interval to a reverse side of a book cover sheet with a book cover pattern, a title or the like drawn thereon, and the kit comprising a book cover sheet and a book cover core body, in which the book cover core body is comprising the front cover core, the back cover core, and a holding part having the same width as the above-mentioned interval, with the front cover core and the back cover core being held integrally with each other through an intermediation of the holding part, and in which, after the front cover core and the back cover core have been glued to the reverse side of the book cover sheet, the holding part is separable from the front cover core and the back cover core.

Further, according to the present invention, there is provided a band-like adhesive tape to which a portion corresponding to the thickness of a plurality of text sheets is glued to form a text set and which is attached to the inner side of the book cover member prepared by using the above-mentioned book cover core body to integrate the book cover member and the text set with each other, in which surface thereof to which the text sheets are glued has an adhesion surface formed of an adhesive not cured even when exposed to an atmosphere and constantly exhibiting an adhesive force, making it possible to freely effect attachment and detachment of text sheets.

In the present invention, the book cover member is equipped with a front cover part, a spine part, and a back cover part by gluing at least a front cover core and a back cover core at a predetermined interval L to the reverse side of a book cover sheet with a book cover pattern, a title, etc. drawn thereon; when forming a book by holding a plurality of text sheets on the inner side thereof (the front cover core side and the back cover core side), it is used as the cover of the original book. The distance L between the front cover core and the back cover core is adjusted as appropriate according to the thickness of the plurality of text sheets bound into the original book. That is, in order that the spine of the original book may be formed when the book cover member holds the plurality of text sheets, there is at least provided a width corresponding to this spine. Further, regarding this book cover member, it is also possible to glue a spine core to a portion corresponding to the predetermined distance L to thereby form the spine part.

Regarding the book cover sheet forming the book cover member, it allows selection as appropriate according to the taste of the individual. For example, it is possible to use a print sheet allowing printing of characters, images, etc. by an ordinary home-use printer, or to use a print sheet the surface of which has undergone inkjet coating or is made suitable for laser printing, with a title, patterns, illustrations, characters, etc. designed and printed thereon, or to use a generally used sheet with a title, patterns, etc. provided thereon by the individual. Apart from this, it is also possible to use a paperboard with colors, patterns, etc., wrapping paper or the like. The cover sheet may be formed of paper, Japanese paper, cloth, or a synthetic resin film. While the cover sheet may be composed of a single sheet including the front cover part, the spine part, and the back cover part, when, for example, the size of the book to be formed is relatively large, it may be divided into a plurality of pieces for each of the front cover, the spine, and the back cover.

Further, in the present invention, when a kit for manufacturing a book cover member is formed by a book cover sheet and a book cover core body, it is possible to use the sheets as mentioned above in the state prior to printing or the like, i.e., blank sheets, as the components. Further, regarding this book cover sheet, it is desirable for the book cover member to be divided into regions corresponding to the front cover part, the back cover part, and the spine part by previously effecting scoring or the like thereon. If the division into those regions is previously effected, it will help to indicate the proper positions when patterns, a title or the like are to be printed or drawn thereon. Usually, when providing a predetermined pattern or title in the regions of the cover sheet corresponding to the front cover part, the back cover part, and the spine part, it is necessary, for proper layout, to previously effect division into the regions by lines drawn by pencil or printing or the like. However, if those lines are allowed to remain after the preparation of the book cover member, there is a fear of the outward appearance thereof being impaired. Thus, by providing protrusions and recesses for the cover by scoring as mentioned above, it is possible to fold the cover sheet by using those protrusions and recesses as the marks after providing a predetermined pattern or the like by printing or the like, thereby making it possible to finish the book cover member neatly and easily.

Regarding the material of the front cover core and the back cover core, there are no particular limitations as long as they are relatively thick and superior in rigidity to a certain degree; for example, it is possible to use cardboard paper sheets or synthetic resin sheets.

Regarding the holding part for the cover cores, it is only necessary for it to integrally hold the front cover core and the back cover core at both ends thereof and to hold them so as to maintain the predetermined distance L between the cores at least until the front cover core and the back cover core are glued to the reverse side of book the cover sheet. There are no particular limitations regarding the material of the holding part; for example, it may be formed of a paper sheet or a synthetic resin sheet with a certain degree of thickness. Further, since the distance L is to be maintained between the front cover core and the back cover core, it is also possible for at least a part of the holding part to be formed so as to have the same width as the distance L.

Further, in the present invention, after the front cover core and the back cover core are held integrally through the intermediation of the holding part, and the front cover core and the back cover core are glued to the reverse side of the book cover sheet, it is necessary for the holding part to be capable of being separated from the front cover core and the back cover core. This form may be realized, for example, as follows: the front cover core and the back cover core are connected to both ends of the holding part through cutting lines having dot-like connecting portions; after the front cover core and the back cover core are glued to the reverse side of the book cover sheet, the holding part can be separated from the front cover core and the back cover core with a relatively small force.

In another example, a mat having a predetermined area larger than that of the holding part is glued to one of the obverse and reverse surfaces of the holding part, and the front cover core and the back cover core formed separately from the holding part are temporarily fixed to this mat so as to be integrated through the intermediation of the holding part. After the front cover core and the back cover core are glued to the reverse side of the book cover sheet, the portions temporarily fixed to the mat are separated therefrom, and the holding part is removed together with the mat.

In still another example, the holding part forms a frame body together with a peripheral edge portion extending from the holding part so as to surround the peripheral edges of the front cover core and the back cover core. This frame body and the front cover core are divided from each other by a first cutting line provided along the contour of the front cover core. Further, the frame body and the back cover core are divided from each other by a second cutting line provided along the contour of the back cover core. That is, the front cover core is held within the first cutting line, and the back cover core is held within the second cutting line. After the front cover core and the back cover core are glued to the reverse side of the book cover sheet, the frame body is removed from the front cover core and the back cover core.

In the above example in which the frame body is formed, it is possible, as in the above-mentioned example, for the first cutting line and the second cutting line to be cutting lines with dot-like connecting portions, or it is possible to provide a mat glued to one surface of the frame body.

When the book cover member forms a spine part, with a spine core being glued to the portion between the front cover core and the back cover core, the spine core and the holding part are formed integrally. Further, after the spine core is glued to the reverse side of the book cover sheet, it is desirable for the holding part to be separable from the spine core. This method, in which the spine core and the holding part are integrated, may be adopted in the same manner as in the case in which the back cover or the back cover core is integrated with the holding part.

In the present invention, it is possible for the front cover core forming the book cover member to be composed of a rectangular front cover core main body and a band-like front cover core auxiliary body arranged along one holding part side of the front cover core main body with a predetermined gap between itself and the front cover core main body. Similarly, it is possible for the back cover core to be composed of a rectangular back cover core main body and a band-like back cover core auxiliary body arranged along one holding part side of the back cover core main body with a predetermined gap between itself and the back cover core main body. When each of the front cover core and the back cover core is divided into a core main body and a band-like core auxiliary body, it is easier for the gutter portion of the text sheets to be spread when the book cover member is obtained and the book is formed with a plurality of text sheets held on the inner side of the book cover member.

When the front cover core or the back cover core is composed of a core main body and a core auxiliary body, a spacer is provided between the core main body and the core auxiliary body, with a predetermined gap being formed therebetween. This spacer is formed integrally with the frame body; for example, between the front cover core main body and the front cover core auxiliary body, there is provided a spacer integrated with the frame body, and the frame body and the front cover core main body are divided from each other by a first main body cutting line provided along the contour of the front cover core main body. Further, the frame body and the front cover core auxiliary body are divided from each other by a first auxiliary body cutting line. Regarding the back cover core, as in the front cover core, the core main body and the core auxiliary body are divided from the frame body by a second main body cutting line and a second auxiliary body cutting line.

Further, in the present invention, the book cover sheet forming the book cover member is prepared to be larger than the spread dimension of the book cover member. After gluing the front cover core and the back cover core to the reverse side of this book cover sheet (surface on the side opposite to surface where the cover pattern, the title, etc. are drawn), the surplus cover sheet portions of the front cover core and the back cover core on the upper edge side, the lower edge side, and the outer edge side (edge side) may be folded back. This makes it possible to finish the book cover member more neatly.

In the case in which the holding part of the book cover core body forms the frame body together with the peripheral edge portion, it is desirable for the width of this peripheral edge portion to be substantially the same as the width corresponding to the portion folded back of the book cover sheet. In this construction, by performing positioning on the book cover sheet with respect to the book cover core body when gluing the front cover core and the back cover core to the reverse side of the book cover sheet, it is possible to cut the book cover sheet in a predetermined size along the contour of the frame body. In this process, by applying a cutting edge of a cutter or the like along the contour of the frame body, it is possible to cut the book cover sheet in a predetermined size without using a ruler or the like. In this case, when the four corners (corner portions) of the peripheral edge portion forming the frame body are previously cut away, the four corners of the book cover sheet can also be cut away along the frame body, thereby making it possible to finish the four corners of the book cover member more neatly.

Further, in the present invention, when the holding part forms the frame body together with the peripheral edge portion, and the front cover core and the back cover core are respectively held within the cutting lines, it is possible for the frame body to have an opening with an open portion on the front cover core side and an opening with an open portion on the back cover core side. By providing the above-mentioned openings, the front cover core and the back cover core held within the cutting lines can be easily separated from the frame body. Similarly, when the book cover core body includes the spine core, it is possible to provide an opening as described above in the frame body.

Further, in the present invention, the front cover core, the back cover core, and the holding part (including the spine core in some cases, which applies to the following description) may be formed of different materials; however, it is desirable that the front cover core, the back cover core, and the holding part be all formed of the same material. For example, by preparing a single plate-like thick paper sheet or the like, and providing therein such cutting lines (or cutting lines having dot-like connecting portions) that divide the single plate-like thick paper sheet into the front cover core, the back cover core, and the holding part, it is possible to obtain the book cover core body. That is, by reducing the number of steps, it is possible to obtain the book cover core body in an advantageous manner also in terms of cost. When the holding part forms the frame body together with the peripheral edge portion also, by adopting the same arrangement, it is possible to obtain the book cover core body from a single thick paper sheet or the like of a predetermined size, thus reducing the number of steps, which is advantageous also in terms of cost.

To prepare a book cover member by using the book cover core body of the present invention, positioning is first effected such that the book cover sheet is at a predetermined position with respect to the front cover core and the back cover core integrally held through the intermediation of the holding part. In this process, to facilitate the positioning, it is also possible to previously provide the book cover core body and the book cover sheet with a positioning means. For example, it is possible to provide a protrusion to a part of the book cover core body, and to provide the book cover sheet with a positioning hole into which the above-mentioned protrusion is inserted with positioning being effected with respect to the book cover core. Further, to finish the book cover member more neatly and to protect the book cover sheet from water, stain, or the like, it is also possible to attach, through the intermediation of an adhesive, a transparent protective film or the like to the surface of the book cover sheet which is set in position with respect to the book cover core body. An attempt to attach a film-like object to the book cover sheet with the cover cores glued thereto is likely to involve wrinkling or air intrusion at a position corresponding to the gap portion between the cover cores; however, by using the book core body in which the cover cores are previously integrated with each other, such problems can be avoided.

Next, the front cover core and the back cover core (with the spine core included in some cases, which applies to the following description) is glued to the reverse side of the book cover sheet set in position with respect to the book cover core body. In this process, it is possible to use an adhesive to bond the book cover sheet and the cover cores to each other; more preferably, however, adhesion surfaces with adhesive previously applieed thereto are provided on the surfaces of the cover cores opposed to the reverse side of the book cover sheet, and the adhesion surfaces are protected by release paper sheets. By providing the adhesion surfaces that are thus protected by the release paper sheets, it is possible to avoid adhesion of the adhesive to the bonding portions in an amount more than necessary or adhesion of the adhesive to undesired portions other than the bonding portions, which would lead to staining, thus making it possible to perform the operation of preparing the book cover member easily and reliably. Further, preferably, it is also possible to provide adhesion surfaces protected by the release paper sheets as described above along the upper edge side, the lower edge side, and the outer edge side of the surfaces of the cover cores on the side opposite to the surfaces thereof opposed to the book cover sheet, gluing the portions folded back of the book cover sheet.

With the book cover member prepared by using the book cover core body of the present invention, it is possible to freely bind text sheets selected according to a taste of an individual by holding and gluing on the inner side thereof a plurality of text sheets with texts, illustrations, etc. provided thereon. In this process, as a means for binding the plurality of text sheets, it is possible to use a stapler or the like or a band-like binding tape having an adhesion surface protected by a release paper sheet extending in a longitudinal direction thereof. When using the above-mentioned binding tape, there are prepared a predetermined number of binding tapes having the adhesion surfaces to which gutter portions of the text sheets are glued, and the binding tapes are glued together with one superimposed on the other, whereby it is possible to form a text set in which each text sheet can be opened and closed. The gutter portion of this text set is held in and glued to the book cover member.

Further, it is also possible to use a band-like adhesive tape having a predetermined width and provided with an adhesion surface extending in a longitudinal direction thereof. That is, a plurality of text sheets are superimposed one upon the other and a portion thereof corresponding to a thickness thereof is glued to this adhesion surface, whereby it is possible to obtain a text set in which the text sheets can be opened and closed. Bookbinding is possible by holding the gutter portion of the text set in the book cover member and gluing the gutter portion thereto. In this regard, it is desirable for the adhesion surface of the adhesive tape to be formed of an adhesive not cured if exposed to the atmosphere and constantly exhibiting an adhesive force. As the above-mentioned adhesive, it is possible, for example, to use a synthetic rubber type glue with natural rubber added thereto; by gluing one ends of the text sheets (portions corresponding to the thickness) to the adhesion surface formed of the above-mentioned adhesive, the text sheets are not detached therefrom due to a strong adhesive force of the adhesion surface, thus making it possible to hold the sheets firmly. In addition, since the adhesion surface is not cured, it is also possible to attach and detach arbitrary text sheets to and from the text set bound by gluing the portion corresponding to the thickness of the text sheets without damaging the text sheets. Further, it is also possible to add new text sheets prepared separately.

EFFECTS OF THE INVENTION

In performing the operation of preparing the book cover member, it is necessary to glue the cover cores at proper positions on the book cover sheet with the cover pattern, title, etc. provided thereon; in particular, the gluing operation is conducted when watching the reverse side of the book cover sheet (the surface on the side opposite to the surface where the cover pattern, etc. are drawn); thus, of the bookbinding operations, the gluing operation is relatively hard to perform. In this regard, when the book cover core body of the present invention is used, since the front cover core and the back cover core are previously integrated in a predetermined positional relationship through the intermediation of the holding part, it is possible to make an adjustment and perform gluing of the book cover sheet with respect to the book cover core body while watching the pattern, etc. thereof. Thus, it is possible to glue the cover cores to the book cover sheet reliably and with high accuracy without particularly using any auxiliary tool such as a ruler or a stabbing. In particular, this is suitable for a case in which an individual binds limited-edition photos or the like into an original book.

In this way, the preparation of an original book is made easier than ever, so it is possible to easily finish picture postcards, New Year's greeting post cards, greeting cards, printed photos, visiting cards, menus, various list slips, pictures or original cards drawn by the individual, and the like into a neatly covered book, making it possible to easily provide for various articles to be viewed that have been collectively stored in a form of an original book having a nature of a personal album, library, collection of works or the like.

BRIEF DESCRIPTION OF THE DRAWINGS

FIG. 1 is an explanatory perspective view of a book cover core body X according to an embodiment of the present invention, of which portion (A) shows a obverse and portion (B) shows a reverse thereof.

FIG. 2 is an explanatory perspective view showing how positioning is effected on a book cover sheet 17 with respect to the book cover core body X of the embodiment of the present invention. The encircled portion is an enlarged view.

FIG. 3 is an explanatory perspective view showing how a front cover core 3 and a back cover core 6 are glued to the reverse side of the book cover sheet 17.

FIG. 4 is an explanatory perspective view showing how a protective film 19 is attached to the surface of the book cover sheet 17.

FIG. 5 is an explanatory (partial) plan view showing how the book cover sheet 17 is cut in a predetermined size.

FIG. 6 is an explanatory perspective view showing how the book cover sheet 17 with the front cover core 3 and the back cover core 6 glued thereto is detached from a frame body 9.

FIG. 7 is an explanatory perspective view showing how the upper edge side, the lower edge side, and the outer edge side of the book cover sheet 17 are processed to complete a book cover member 20.

FIG. 8 is an explanatory perspective view showing how text sheets 21 are glued to an adhesive tape 22 to form a text set 23.

FIG. 9 is an explanatory sectional view showing how the text set 23 equipped with end leaves 24 is incorporated into the book cover member 20.

FIG. 10 is an explanatory perspective view of an original book completed by using the book cover member 20 of the embodiment of the present invention.

DESCRIPTION OF SYMBOLS

Figure 1:
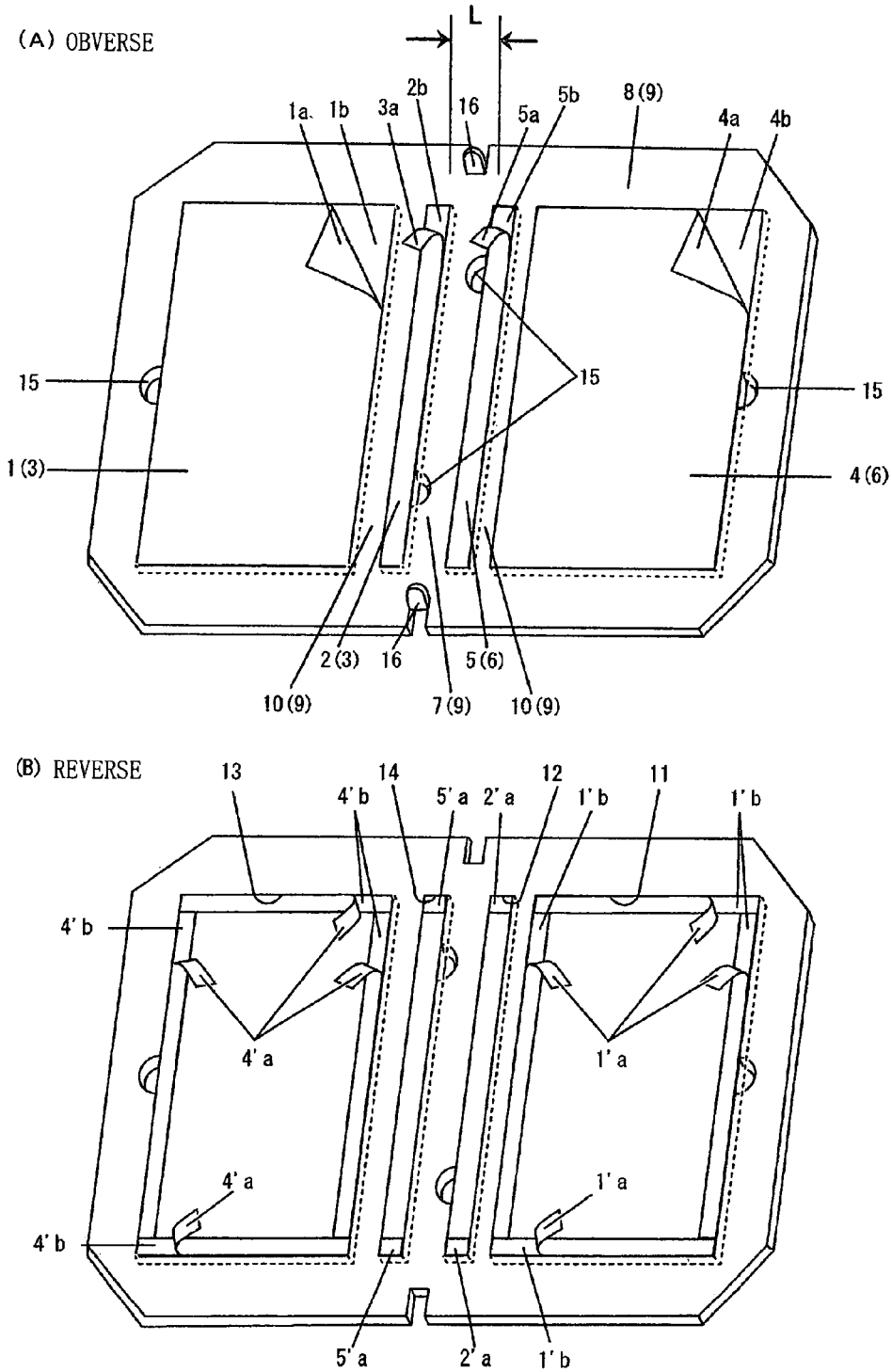
[FIG. 1]

X: Book Cover Core Body
1: rectangular front cover core main body
2: front cover core auxiliary body
3: front cover core
4: back cover core main body
5: back cover core auxiliary body
6: back cover core
7: holding part
8: peripheral edge portion
9: frame body
10: spacer
11: first main body cutting line
12: first auxiliary body cutting line
13: second main body cutting line
14: second auxiliary body cutting line
15: opening
16: protrusion
17: book cover sheet
18: mating hole
19: protective film
20: book cover member
20*x*; front cover portion, 20*y*: back cover portion, 20*z*: spine portion
21: text sheet
22: adhesive tape
23: text set
24: end leave
1*a*,2*a*,4*a*,5*a*,1'*a*,2'*a*,4'*a*,5'*a*,19'*a*,and 22*a*:release paper sheet
1*b*,2*b*,4*b*,5*b*,1'*b*,2'*b*,4'*b*,5'*b*,19'*b*,and 22*b*:adhesion surface

BEST MODE FOR CARRYING OUT THE INVENTION

In the following, a preferred mode of the present invention will be specifically described with reference to an embodiment shown in the accompanying drawings.

[Preparation of the Book Cover Member Using the Book Cover Core Body X]

Figure 2:
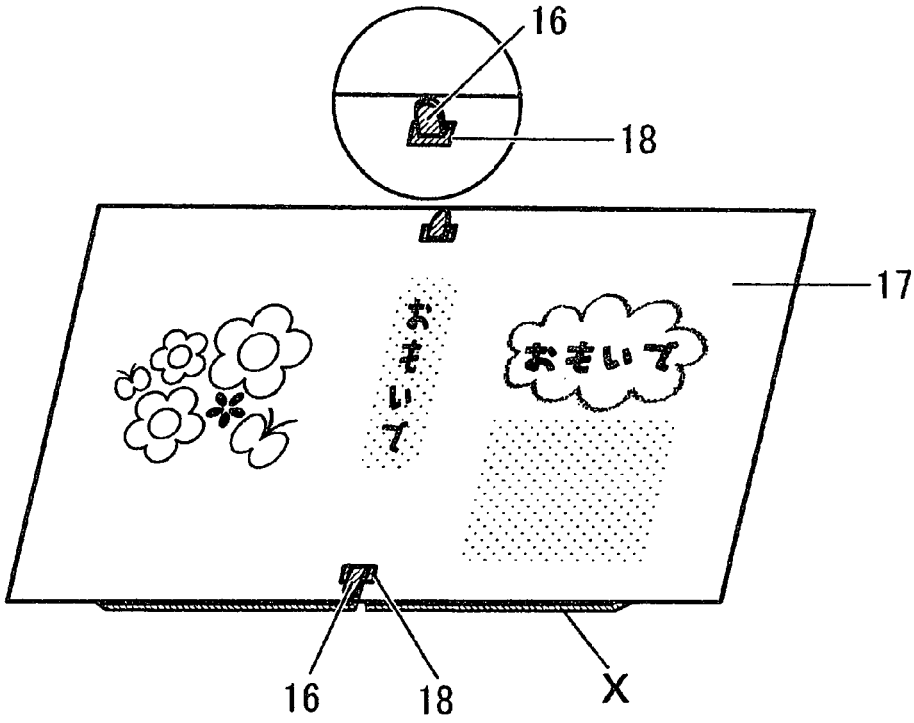
[FIG. 2]

FIG. 1 is an explanatory perspective view of a book cover core body X for preparing a book cover member according to an embodiment of the present invention, and FIG. 2 is an explanatory plan view showing how a book cover sheet 17 is superimposed on the book cover core body X. The book cover core body X and the book cover sheet 17 constitute a kit for manufacturing a book cover member. In the following, those components will be described in detail.

FIG. 1(A) shows the obverse (the cover sheet side) of the book cover core body X, and FIG. 1(B) shows the reverse (the end leaves side) of the book cover core body X. The book cover core body X has a front cover core 3 consisting of a rectangular front cover core main body 1 and a band-like front cover core auxiliary body 2, and a back cover core 6 consisting of a rectangular back cover core main body 4 and a band-like back cover core auxiliary body 5, with the front cover core 3 and the back cover core 6 being a distance L through the intermediation of a holding part 7 having a width L. The holding part 7 forms a frame body 9 together with a peripheral edge portion 8 extended from the holding part 7 so as to surround the peripheral edges of the front cover core 3 (inclusive of the front cover core main body 1 and the front cover core auxiliary body 2, which applies to the following description) and the back cover core 6 (inclusive of the back cover core main body 4 and the back cover core auxiliary body 5, which applies to the following description). Further, between the front cover core main body 1 and the front cover core auxiliary body 2, and between the back cover core main body 4 and the back cover core auxiliary body 5, there exist spacers 10 each formed integrally with the frame body 9.

The front cover core 3, the back cover core 6, and the frame body 9, which form the book cover core body X, are formed of a single cardboard paper sheet having a relatively large thickness; of those, the front cover core main body 1 is divided from the frame body 9 by a first main body cutting line 11 formed along the contour thereof; the front cover core auxiliary body 2 is divided from the frame body 9 by a first auxiliary body cutting line 12 formed along the contour thereof; further, the back cover core main body 4 is divided from the frame body 9 by a second main body cutting line 13 formed along the contour thereof; and the back cover core auxiliary body 5 is divided by a second auxiliary body cutting line 14 formed along the contour thereof.

In this embodiment, the front cover core main body 1 and the back cover core main body 4 are formed in the same size, and the front cover core auxiliary body 2 and the back cover core auxiliary body 5 are formed in the same size. Further, on the surface constituting the outer side (the cover side) when the front cover core main body 1, the front cover core auxiliary body 2, the back cover core main body 4, and the back cover core auxiliary body 5 are bound into a book, there are provided adhesion surfaces 1*b*, 2*b*,4*b*,and 5*b* respectively protected by release paper sheets 1*a*, 2*a*,4*a*,and 5*a* (FIG. 1(A)). Regarding the surface constituting the inner side (the end leaves side) when the front cover core main body 1, the front cover core auxiliary body 2, the back cover core main body 4, and the back cover core auxiliary body 5 are bound into a book, there are provided band-like adhesion surfaces 1'*b*, 2'*b*,4'*b*,and 5'*b* protected by band-like release paper sheets 1'*a*, 2*a*,4'*a*,and 5'*a* on the upper edge side, the lower edge side, the inner edge side (the back cover side) and the outer edge side (the edge side) of the front cover core main body 1 and the back cover core main body 4, and on the upper edge side and the lower edge side of the front cover core auxiliary body 2 and the back cover core auxiliary body 5 (FIG. 1(B)).

Further, the frame body 9 is equipped with openings 15 having open portions facing the front cover core main body 1, the front cover core auxiliary body 2, the back cover core main body 4, and the back cover core auxiliary body 5; at the upper edge side and the lower edge side of the frame body 9, there are partially provided notches, where there are provided protrusions 16 indicating the center of the holding part 7 (the center of the distance L).

To manufacture a book cover member by using the book cover core body X of this embodiment, there is first prepared, as shown in FIG. 2, a book cover sheet 17 on which a pattern, illustration, title, name of the author, etc. are previously printed at the portions corresponding to the front cover, the spine, and the back cover, and the book cover sheet 17 is superimposed on the surface of the book cover core body X to effect positioning thereon. In this regard, on the upper edge side and the lower edge side of the book cover sheet 17, there are previously provided mating holes 18 at positions corresponding to the center of the back cover, whereby the positioning of the book cover sheet 17 with respect to the book cover core body X can be easily effected by fitting the protrusions 16 of the book cover core body X into the mating holes 18.

Figure 3:
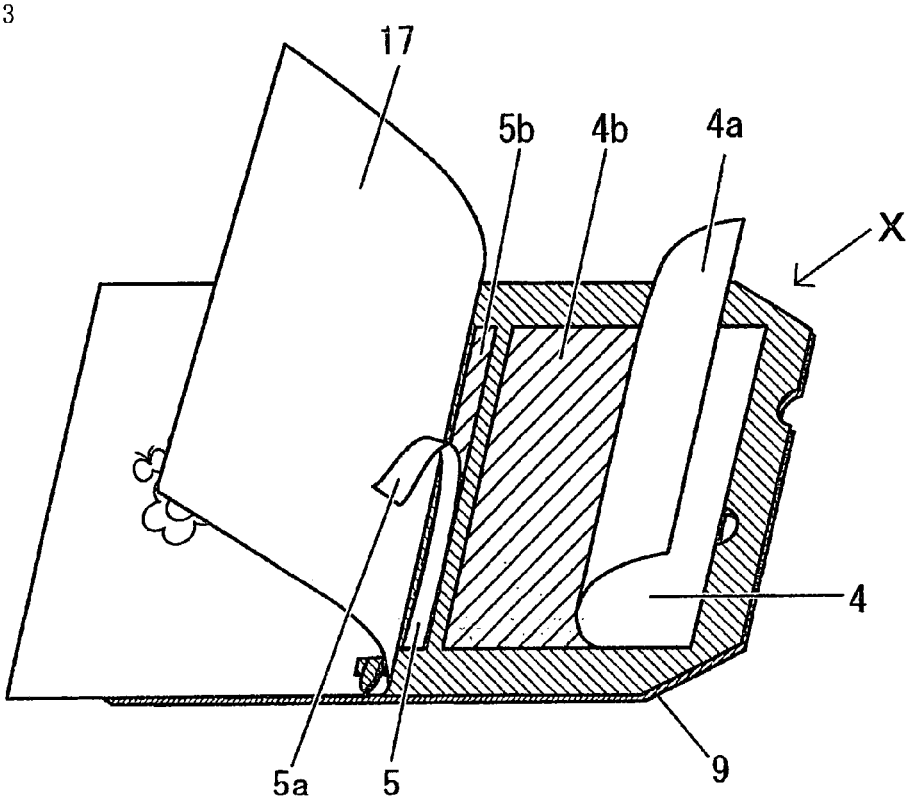
[FIG. 3]

Next, as shown in FIG. 3, the book cover sheet 17 is raised by half from the book cover core body X such that the book cover sheet 17 is not detached from the protrusions 16, and the release paper sheets 4*a* and 5*a* of the back cover core main body 4 and the back cover core auxiliary body 5 are separated to expose the adhesion surfaces 4*b* and 5*b*,gluing the back cover core main body 4 and the back cover core auxiliary body 5 to the reverse side of the book cover sheet 17 (the surface where no patterns or the like are drawn). Similarly, the remaining half of the book cover sheet 17 is raised to effect gluing to the reverse side of the book cover sheet 17 also with respect to the front cover core main body 1 and the front cover core auxiliary body 2.

Figure 4:
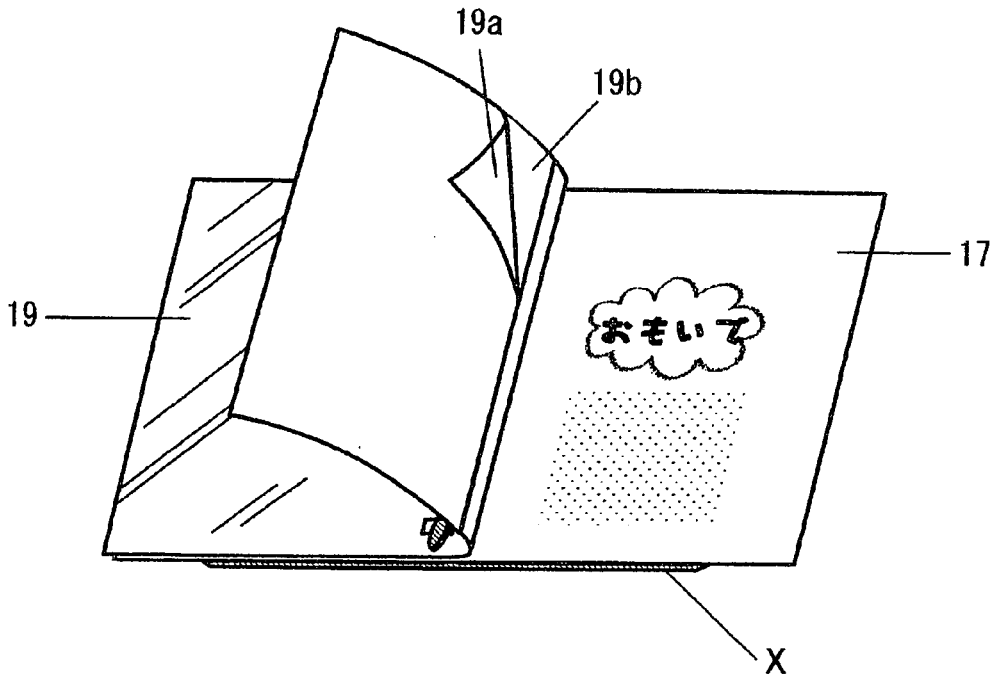
[FIG. 4]

Further, as shown in FIG. 4, to finish the book cover member more neatly and protect it from water, stain or the like, a transparent protective film 19 may be further attached to the surface of the book cover sheet 17 with the front cover core 3 and the back cover core 6 glued thereto. Regarding the protective film 19, there is provided on one side thereof an adhesion surface 19*b* protected by a release paper sheet 19*a* divided into two near the center thereof; after effecting positioning on the book cover sheet 17, only one of the front cover core side and the back cover core side is raised to be glued to the book cover sheet 17; and the remaining half is glued to the book cover sheet 17 in the same manner. In this process, the protrusions 16 of the book cover core body X fitted into the mating holes 18 as stoppers are pulled out of the mating holes 18 of the book cover sheet 17 when attaching the protective film 19.

Figure 5:
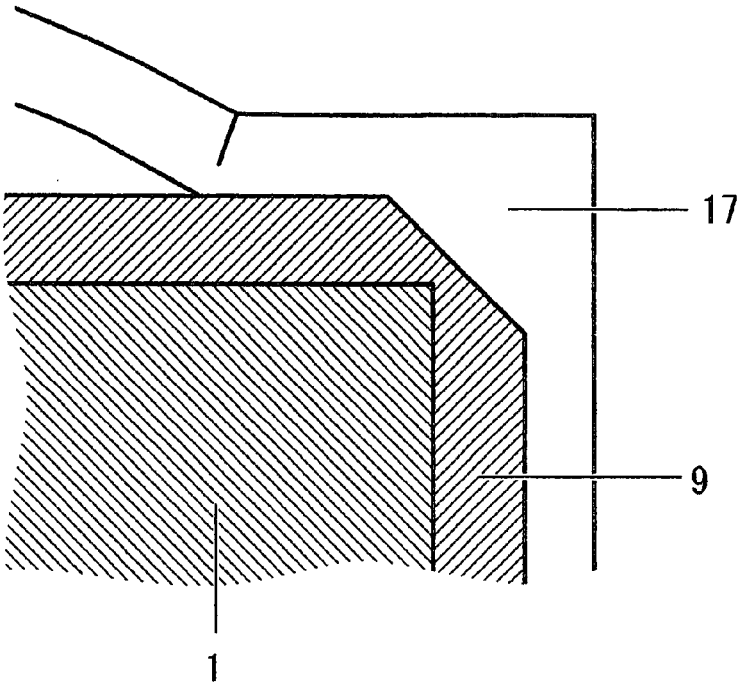
[FIG. 5]

Next, as shown in FIG. 5, the book cover core body X is turned over, with the book cover sheet 17 being set in position, and the surplus portion of the book cover sheet 17 sticking out of the frame body 9 is cut away along the contour of the frame body 9. In this process, it is desirable to cut away the four corners (the corner portions) of the book cover sheet 17 along the configuration of the frame body 9, whose four corners are cut away.

Figure 6:
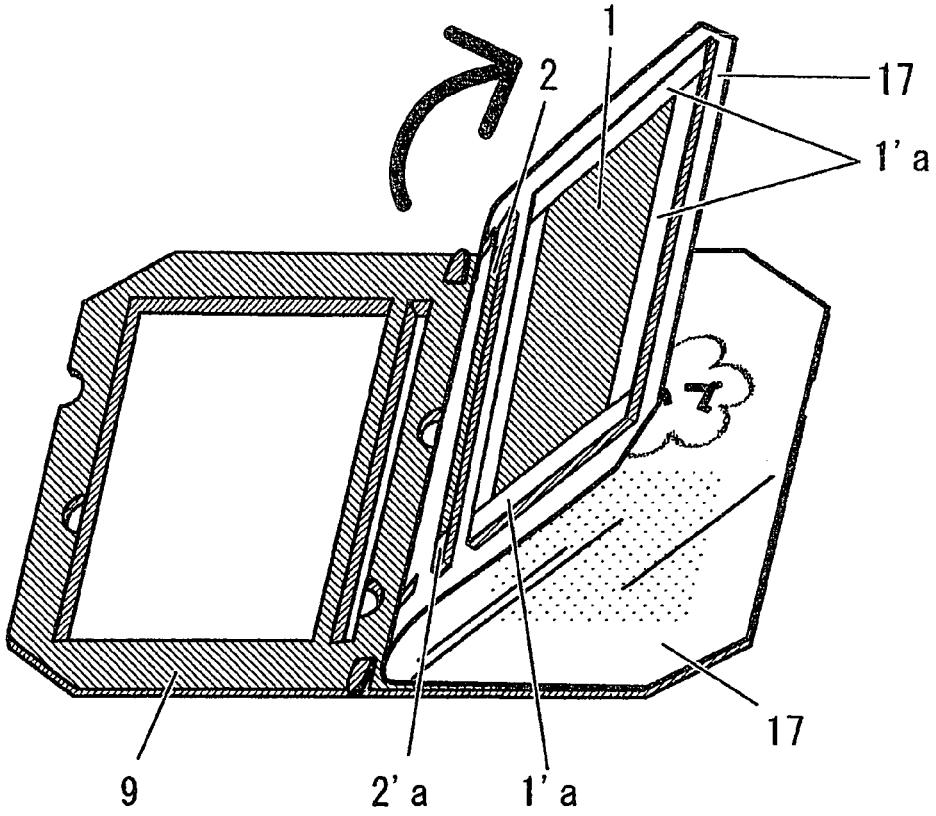
[FIG. 6]
Figure 7:
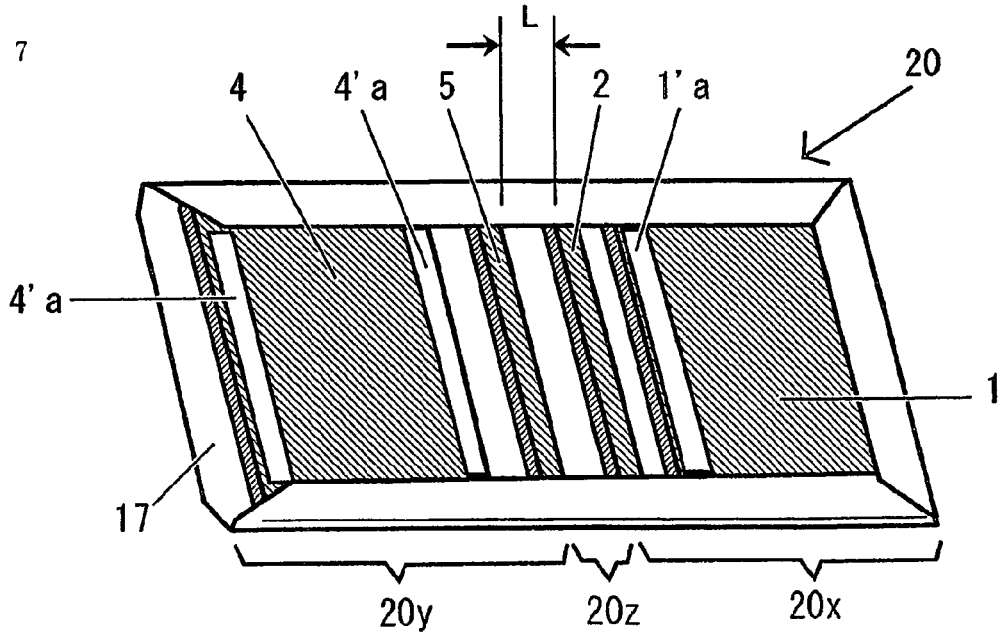
[FIG. 7]

After the book cover sheet 17 has been processed as described above, the book cover sheet 17 with the front cover core 3 and the back cover core 6 glued thereto is detached from the frame body 9 as shown in FIG. 6. In this process, the operation is facilitated when the front cover core 3 and the back cover core 6 are removed by utilizing the openings 15 provided in the frame body 9. Next, as shown in FIG. 7, the upper edge side, the lower edge side, and the outer edge side of the book cover sheet 17 removed from the frame body 9 are folded back, and are glued to the adhesion surfaces 1'*b* and 4'*b* provided on the upper edge side, the lower edge side, and the outer edge side of the inner side (the end leaves side) of the front cover core main body 1 and the back cover core main body 4, and to the adhesion surfaces 2'*b* and 5'*b* provided on the upper edge side and the lower edge side of the inner side (the end leaves side) of the front cover core auxiliary body 2 and the back cover core auxiliary body 5, thereby completing a book cover member 20 equipped with a front cover portion 20*x*,a back cover portion 20*y*,and a spine portion 20*z*.

Bookbinding Using the Book Cover Member

Figure 8:
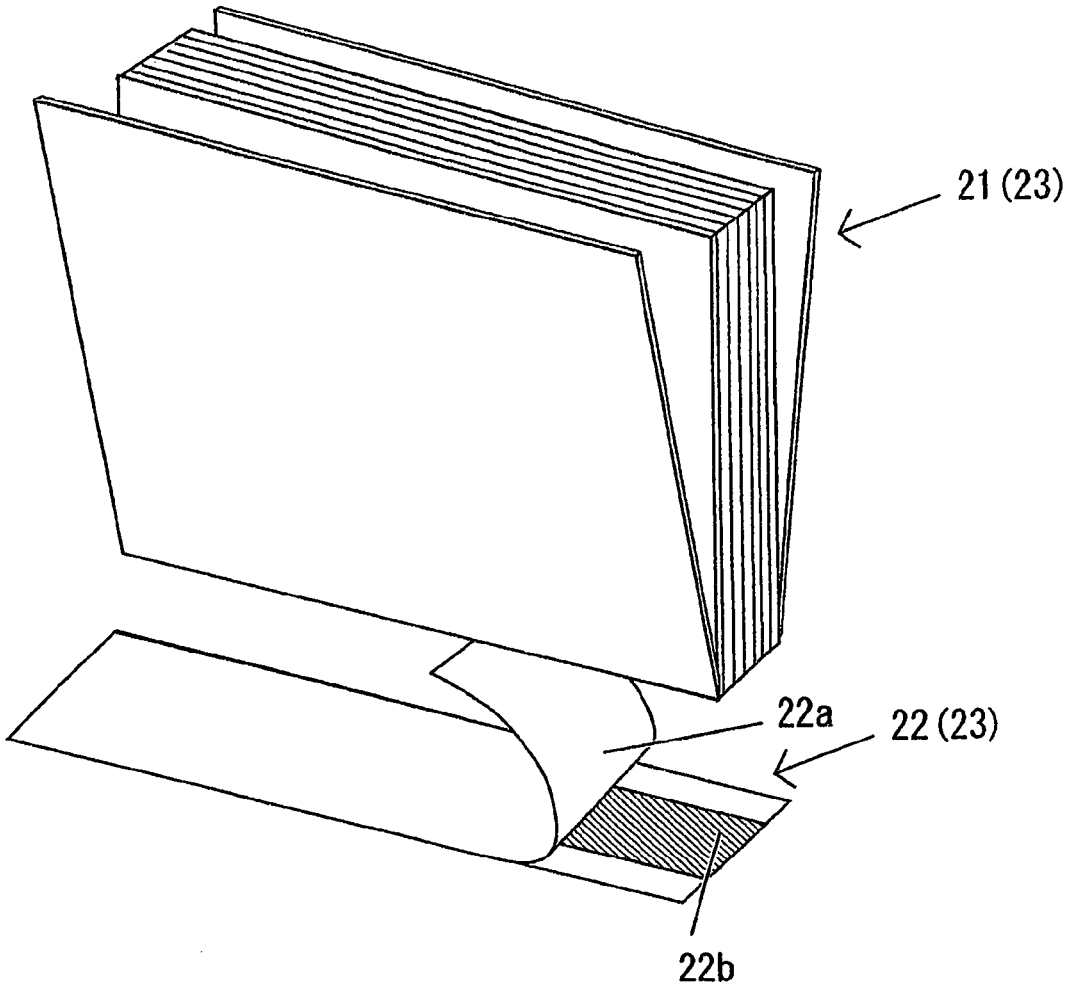
[FIG. 8]

As shown in FIG. 8, card-shaped text sheets 21 each having texts such as sentences and photographs printed on both sides are selected as appropriate according to the taste of the individual, and a plurality of text sheets 21 are prepared such that their thickness when stacked together becomes substantially the same as the width L of the spine portion 20*z* of the book cover member 20 (the distance L between the front cover core auxiliary body 2 and the back cover core auxiliary body 5), and the text sheets 21 are superimposed one upon the other in an order according to the story or the like. Further, there is prepared a band-like adhesive tape 22 having the same length as that (in the top-bottom direction) of the text sheets 21. The adhesive tape 22 has an adhesion surface 22*b* protected by a release paper sheet 22*a* extending in the longitudinal direction thereof, and the adhesion surface 22*b* has a width slightly larger than the thickness of the plurality of text sheets 21 stacked together. Here, the plurality of text sheets 21 are aligned on the gutter side, and the back portion formed by each text sheet 21 is glued to the adhesion surface 22*b* of the adhesive tape 22 (with each text sheet 21 being held in contact with the adhesion surface with the thickness thereof), thereby forming a text set 23 in which a plurality of text sheets 21 can be opened and closed. Here, it is desirable for the adhesion surface 22*b* of the adhesive tape 22 to be formed by applying an adhesive consisting of a synthetic rubber type glue with natural rubber added thereto and not cured even if exposed to the atmosphere to constantly exhibit an adhesive force. By forming the text set 23 by using the adhesive tape 22, it is possible to freely attach and detach the text sheets 21 glued to the adhesive tape 22, thus making it possible to freely change the contents of a text once bound into a book.

Figure 9:
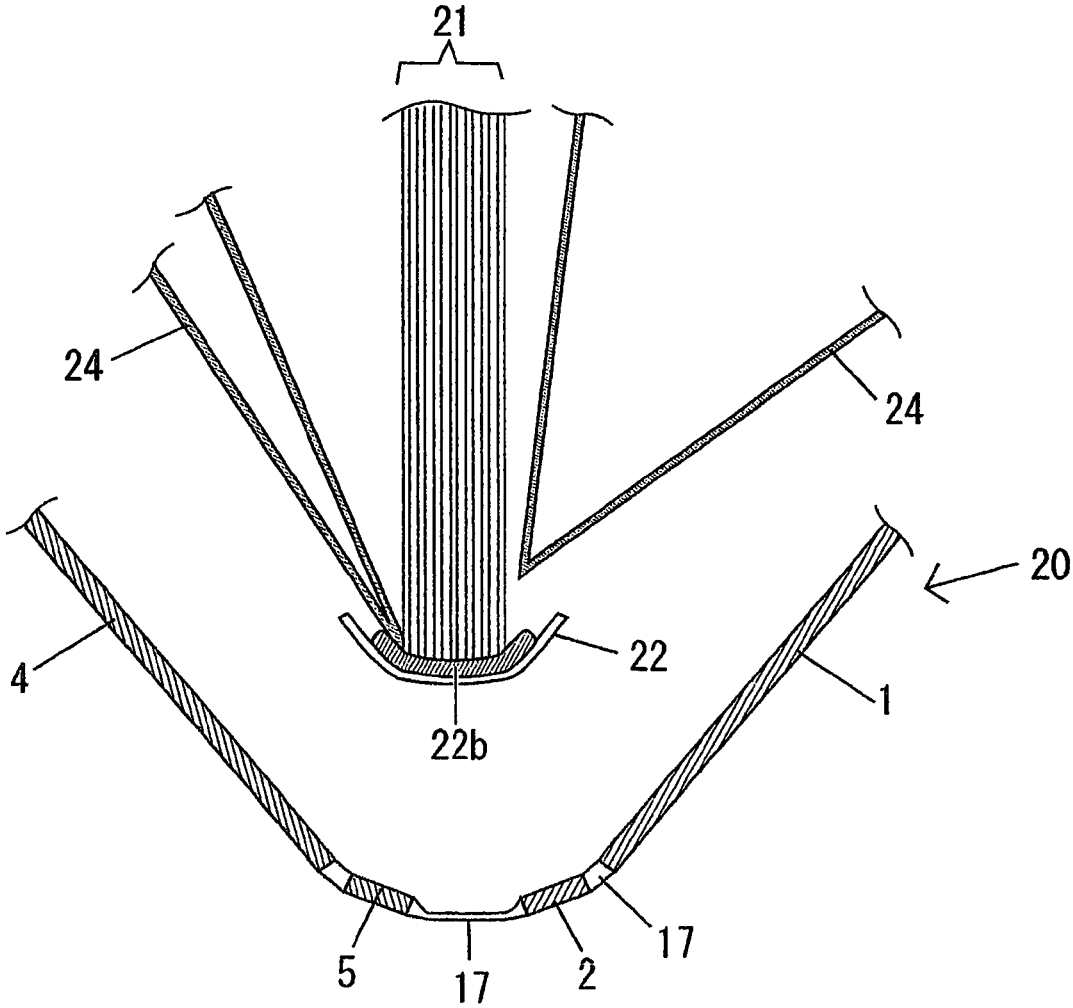
[FIG. 9]

As shown in FIG. 9, it is also possible to glue end leaves 24 respectively to the front side and the rear side of the gutter portion of the text set 23. The end leaves 24 are formed of a firm pattern paper folded into two, and are used so as to connect the previously prepared book cover member 20 and the text set 23; on the upper edge side, the lower edge side, and the outer edge side of the surface glued to the book cover member 20, there are provided adhesion surfaces (not shown) each protected by a release paper sheet. The end leaves 24 can be glued to the text set 23 by utilizing the portions of the adhesion surface 22*b* of the surplus adhesive tape 22 left on the front side and the rear side after the gluing of the text sheets 21.

Figure 10:
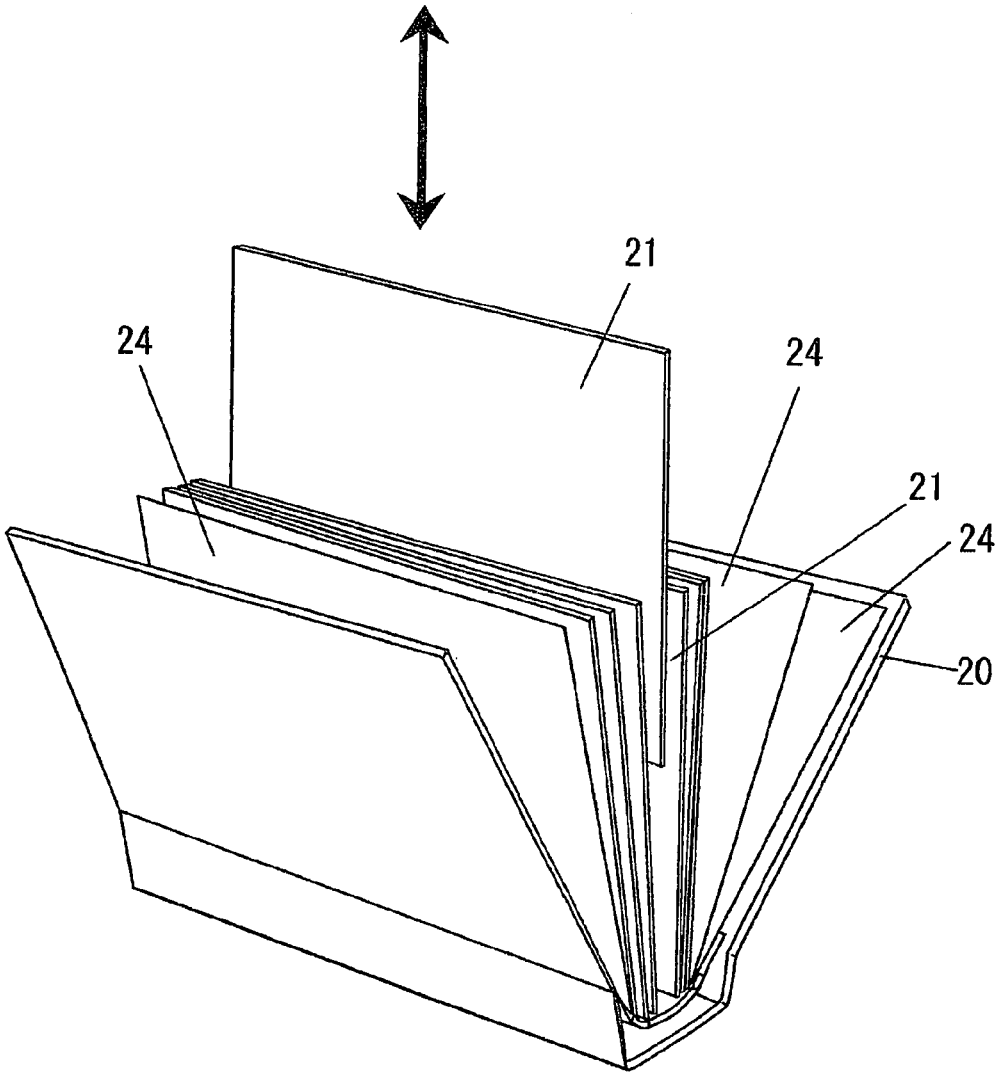
[FIG. 10]

As shown in FIG. 9, the text set 23 thus equipped with the end leaves 24 is arranged at a predetermined position on the inner side of the previously completed book cover member 20, and the inner side (the end leaves side) of the front cover core main body 1 and the back cover core main body 4 and the end leaves 24 are glued to each other by the adhesion surfaces 1'*a* and 4'*a* provided on the inner edge side of the front cover core main body 1 and the back cover core main body 4 and the adhesion surfaces provided on the end leaves 24, thus completing the bookbinding as shown in FIG. 10.

Thus, in the book cover core body X of this embodiment, it is possible to perform positioning as desired with respect to the front cover core 3 and the back cover core 6 while watching the illustration, title, etc. drawn on the surface of the book cover sheet 17, and it is possible to prepare the book cover member 20 easily and reliably without using any auxiliary tool such as a ruler or a stabbing. Further, by using the book cover member 20, it is possible to prepare an original book by bookbinding easily, inexpensively, and neatly. In particular, by using the adhesive tape 22 having an adhesion surface to which there is applied an adhesive not cured even if exposed to the atmosphere and constantly exhibiting an adhesive force, as shown by an arrow in FIG. 10 it is possible to freely remove text sheets 21 without causing any damage once bound together and add new text sheets afterwards.

Industrial Applicability

By using the book cover core body of the present invention, it is possible to easily prepare a book cover member constituting the cover of a book, which is suitable for a case in which an individual prepares an original book according to one's taste. Further, it is also possible to obtain the function of a binder that has conventionally been used to store picture postcards, New Year's greeting post cards, greeting cards, printed photos, visiting cards, menus, various list slips, and pictures or original cards drawn by the individual.

The invention claimed is:

1. A book cover core body for manufacturing a book cover member having a front cover part, a spine part and a back cover part which is made by gluing at least a front cover core and a back cover core at a predetermined interval to a reverse side of a book cover sheet with a book cover pattern, a title or the like drawn thereon, the book cover core body comprising:

the front cover core of the book cover member;

the back cover core of the book cover member; and a frame body, wherein the frame body comprises a holding part, and a peripheral edge portion extending from the holding part so as to surround i) peripheral edges of the front cover core via a first cutting line provided along a contour of the front cover core and ii) peripheral edges of the back cover core via a second cutting line provided along a contour of the back cover core, the holding part has a width corresponding to a width of the spine part, the front cover core and the back cover core are hold integrally through an intermediation of the holding part within the frame body, so that after the front cover core and the back cover core are glued to the reverse side of the book cover sheet, i) the front cover core is separated from the frame body by the first cutting line and the back cover core is separated from the frame body by the second cutting line, and ii) the holding part, which is separated from the front cover core and the back cover core, remains as a part of the frame body, which is not a part of the book manufactured from the book cover core body.

2. A book cover core body for manufacturing a book cover member according to claim 1, further comprising a positioning means for performing positioning on the book cover sheet.

3. A book cover core body for manufacturing a book cover member according to claim 1 or 2, wherein the front cover core, the back cover core, and the holding part are formed of the same material.

4. A book cover core body for manufacturing a book cover member according to claim 1, wherein the front cover core and the back cover core have on their surfaces opposed to the reverse side of the book cover sheet adhesion surfaces each of which is protected by a release paper sheet.

5. A book cover core body for manufacturing a book cover member according to claim 1, wherein the front cover core and the back cover core have adhesion surfaces extending along an upper edge side, a lower edge side, and an outer edge side of a surface on the opposite side of the surfaces opposed to the book cover sheet and each of which is protected by a release paper sheet.

6. A book cover core body for manufacturing a book cover member according to claim 1, wherein when the book cover member forms the spine part by gluing a spine core to a portion between the front cover core and the back cover core, the spine core and the holding part are formed integrally with each other, and wherein after the spine core has been glued to the reverse side of the book cover sheet, the holding part is separable from the spine core.

7. A book cover core body for manufacturing a book cover member according to claim 1, wherein the front cover core is composed of a rectangular front cover core main body and a band-like front cover core auxiliary body arranged along one holding part side of the front cover core main body with a predetermined gap between itself and the front cover core main body, and wherein the back cover core is composed of a rectangular back cover core main body and a band-like back cover core auxiliary body arranged along one holding part side of the back cover core main body with a predetermined gap between itself and the back cover core main body.

8. A book cover core body for manufacturing a book cover member according to claim 7, further comprising:

a spacer formed integrally with the frame body existing between the front cover core main body and the front cover core auxiliary body, the frame body and the front cover core main body being divided from each other by a first main body cutting line provided along the contour of the front cover core main body, the frame body and the front cover core auxiliary body being divided from each other by a first auxiliary body cutting line provided along the contour of the front cover core auxiliary body; and a spacer formed integrally with the frame body existing between the back cover core main body and the back cover core auxiliary body, the frame body and the back cover core auxiliary body being divided from each other by a second main body cutting line provided along the contour of the back cover core main body, the frame body and the back cover core auxiliary body being divided from each other by a second auxiliary body cutting line provided along the contour of the back cover core auxiliary body.

9. A book cover core body for manufacturing a book cover member according to any one of claims 7 through 8, wherein the frame body has an opening with an open portion on the front cover core side and an opening with an open portion on the back cover core side.

10. A book cover core body for manufacturing a book cover member according to claim 1, wherein four corners of the peripheral edge portion are cut away to form the frame body.

11. A book cover core body for manufacturing a book cover member according to claim 1, wherein the width of the peripheral edge portion is substantially the same as a width corresponding to an amount by which the book cover sheet is folded back along the upper edge side, the lower edge side, and the outer edge side of the front cover core and the back cover core after the front cover core and the back cover core are glued to the reverse side of the book cover sheet.

12. A kit for manufacturing a book cover member having a front cover part, a spine part and a back cover part which is made by gluing at least a front cover core and a back cover core at a predetermined interval to a reverse side of a book cover sheet with a book cover pattern, a title or the like drawn thereon, and the kit comprising:

a book cover sheet; and a book cover core body, wherein the book cover core body comprises:

the front cover core of the book cover member;

the back cover core of the book cover member; and a frame body, wherein the frame body comprises a holding part, and a peripheral edge portion extending from the holding part so as to surround i) peripheral edges of the front cover core via a first cutting line provided along a contour of the front cover core and ii) peripheral edges of the back cover core via a second cutting line provided along a contour of the back cover core, the holding part has a width corresponding to a width of the spine part, the front cover core and the back cover core are hold integrally through an intermediation of the holding part within the frame body, so that after the front cover core and the back cover core are glued to the reverse side of the book cover sheet, i) the front cover core is separated from the frame body by the first cutting line and the back cover core is separated from the frame body by the second cutting line, and ii) the holding part, which is separated from the front cover core and the back cover core, remains as a part of the frame body, which is not a part of the book manufactured from the book cover core body.

* * * * *

UNITED STATES PATENT AND TRADEMARK OFFICE

CERTIFICATE OF CORRECTION

PATENT NO. : 8,480,132 B2
APPLICATION NO. : 11/883448
DATED : July 9, 2013
INVENTOR(S) : Hiroshi Kobayashi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1164 days.

Signed and Sealed this
Eighth Day of September, 2015

Michelle K. Lee

Michelle K. Lee
*Director of the United States Patent and Trademark Office*